US010845024B2

(12) United States Patent
Schneider

(10) Patent No.: US 10,845,024 B2
(45) Date of Patent: Nov. 24, 2020

(54) LUMINAIRE AND METHOD FOR FASTENING TWO COMPONENTS

(71) Applicant: Glashutte Limburg Leuchten GmbH + Co. KG, Limburg (DE)

(72) Inventor: Thomas Schneider, Runkel (DE)

(73) Assignee: GLASHÜTTE LIMBURG LEUCHTEN GMBH + CO. KG, Limburg (DE)

( * ) Notice: Subject to any disclaimer, the term of this patent is extended or adjusted under 35 U.S.C. 154(b) by 3 days.

(21) Appl. No.: 16/167,360

(22) Filed: Oct. 22, 2018

(65) Prior Publication Data

US 2019/0120458 A1 Apr. 25, 2019

(30) Foreign Application Priority Data

Oct. 23, 2017 (EP) ..... 17197733

(51) Int. Cl.
*F21V 3/06* (2018.01)
*F21V 17/00* (2006.01)
(Continued)

(52) U.S. Cl.
CPC ..... *F21V 3/061* (2018.02); *F21L 4/00* (2013.01); *F21V 3/00* (2013.01); *F21V 3/02* (2013.01);
(Continued)

(58) Field of Classification Search
None
See application file for complete search history.

(56) References Cited

U.S. PATENT DOCUMENTS 8,388,191 B2 3/2013 Hsieh
2005/0073848 A1 4/2005 King et al.
(Continued)

FOREIGN PATENT DOCUMENTS

CH 706 139 A2 8/2013
CN 106871016 A 6/2017
(Continued)

OTHER PUBLICATIONS

Notification of First Office Action in Chinese Patent Application No. 201811236221.3 dated Jan. 7, 2020.
(Continued)

*Primary Examiner* — Elmito Breval
(74) *Attorney, Agent, or Firm* — Baker & Hostetler LLP

(57) ABSTRACT

A luminaire includes a receiving element for a rotationally symmetrical glass body with a receiving opening, a rotationally symmetrical glass body arranged in the receiving opening and an annular, permanently elastic element arranged between the receiving element and the glass body, wherein the receiving element is formed with a support surface which is inclined towards the glass body and the glass body is formed with a receiving surface diametrically opposite to the support surface. The permanently elastic element is positioned in the installed state between the support surface and the receiving surface in order to fix the receiving element and the glass body positively and concentrically to each other. An annular gap is provided between glass body and receiving element for introducing the annular, permanently elastic element between support surface and receiving surface. A method for fastening the glass body in the receiving element is provided.

14 Claims, 1 Drawing Sheet

(51) Int. Cl.

| | |
|---|---|
| ***F21V 3/02*** | (2006.01) |
| ***F21V 3/00*** | (2015.01) |
| ***F21V 5/00*** | (2018.01) |
| ***F21V 31/00*** | (2006.01) |
| ***F21V 5/04*** | (2006.01) |
| ***F21L 4/00*** | (2006.01) |
| *F21W 131/401* | (2006.01) |
| *F21W 131/308* | (2006.01) |

(52) U.S. Cl.
CPC ..... *F21V 5/006* (2013.01); *F21V 5/048* (2013.01); *F21V 17/00* (2013.01); *F21V 31/005* (2013.01); *F21W 2131/308* (2013.01); *F21W 2131/401* (2013.01)

(56) References Cited

U.S. PATENT DOCUMENTS

| | | | | |
|---|---|---|---|---|
| 2006/0256563 | A1* | 11/2006 | Uke ..... | F21L 4/027 362/335 |
| 2011/0070553 | A1* | 3/2011 | Stempfle ..... | A61C 1/088 433/29 |
| 2012/0243241 | A1 | 9/2012 | Hsieh | |
| 2013/0107509 | A1* | 5/2013 | Opolka ..... | F21L 4/027 362/190 |
| 2015/0168633 | A1* | 6/2015 | Gantenbrink ..... | F21S 8/026 362/308 |
| 2015/0176818 | A1* | 6/2015 | Trager ..... | B21D 53/883 362/375 |

FOREIGN PATENT DOCUMENTS

| | | | | |
|---|---|---|---|---|
| DE | 4110985 | A1 * | 10/1992 | ..... F21V 14/025 |
| DE | 203 05 625 | U1 | 7/2003 | |
| DE | 10 2010 060 395 | A1 | 1/2012 | |
| EP | 2 682 669 | A1 | 1/2014 | |
| WO | 2006/122153 | A1 | 11/2006 | |
| WO | 2009/000591 | A1 | 12/2008 | |
| WO | 2010/022712 | A2 | 3/2010 | |

OTHER PUBLICATIONS

Chinese Notification of Second Office Action issued in Chinese Patent Application No. 201811236221.3 dated Jun. 3, 2020, with English translation.

* cited by examiner

LUMINAIRE AND METHOD FOR FASTENING TWO COMPONENTS

CROSS-REFERENCE TO RELATED APPLICATIONS

This application claims priority to foreign European patent application No. EP 17 197 733.3, filed on Oct. 23, 2017, the disclosure of which is incorporated by reference in its entirety.

FIELD OF THE INVENTION

The present invention refers to a luminaire comprising a receiving element for a rotationally symmetrical glass body with a receiving opening, a rotationally symmetrical glass body arranged in said receiving opening and an annular, permanently elastic element arranged between the receiving element and the glass body.

BACKGROUND

Luminaires comprising a rotationally symmetrical glass body and a receiving element with a receiving opening, in which the glass body is inserted, are widely known. The fixation of the glass body in the region of the receiving element is here a field of particular interest.

For example, CH 706 139 A2 describes a luminaire and in particular a luminaire which is completely water- and water vapor-proof. In this case, a light passage opening is enclosed by an inwardly directed annular end flange which comprises a surrounding shoulder. The light passage opening is covered by a disc-shaped glass element, which also comprises a surrounding shoulder at the edge. In the inserted position, the glass element lies with its shoulder against the corresponding shoulder of the connecting flange. In the region of the shoulder a first ring seal in the form of an O-ring is provided. Furthermore, an annular groove is recessed in the end flange after the shoulder towards the luminaire interior, in which groove a further sealing ring is arranged and seals the joint between glass element and end flange.

The connection of a glass element with an element surrounding it, for example a mount, is also known from other areas, such as photography. For instance, WO 2009/000591 describes a camera objective with a lens mount and a lens received in the lens mount. It is here provided that a positive connection is established between the lateral lens surface and the inner surface of the lens mount, for example a protrusion or a nose is provided on the inner surface of the lens mount, which engages into a groove formed in the lens. In addition, a positive-locking means, such as an O-ring, can also be used here.

Furthermore, a multi-lens zoom system for flashlights is known from WO 2006/122 153 A1. The flashlight comprises an outer housing in which an illumination section and a lens assembly are accommodated. The housing itself is closed by a transparent cover. The lenses are here pressed via a spring system against the upper side of the housing, with an additional seal being inserted between the uppermost lenses and the outer housing.

It has been found that the connection between mount or end element and glass body is associated with considerable effort in order to achieve a good fixation of the same. Usually, tightness as well as rattle-free assembly of the elements is expected.

SUMMARY OF THE INVENTION

It is the object of the present invention is to provide a particularly simple assembly of a glass body in a receiving element that can be used for a wide variety of luminaires.

This object is solved for a luminaire comprising a receiving element for a rotationally symmetrical glass body with a receiving opening, a rotationally symmetrical glass body arranged in said receiving opening and an annular, permanently elastic element arranged between the receiving element and the glass body, in that the receiving element is formed with a support surface which is inclined towards the glass body and the glass body is formed with a receiving surface diametrically opposite to the support surface, wherein the permanently elastic element is positioned in the installed state between the support surface and the receiving surface in order to fix the receiving element and the glass body positively and concentrically to each other, and that an annular gap is provided between glass body and receiving element for introducing the annular, permanently elastic element between support and receiving surface.

The present invention provides a particularly simple assembly of two components, focusing in particular on the special properties of the glass body, which often has production-related tolerances, whereas the receiving elements are usually castings that can be manufactured precisely. Previously, therefore, complex joining processes were generally used, such as gluing or precisely manufactured grooves to join the two elements together.

With the present invention, the connection is achieved via a permanently elastic annular element, which fixes the two elements positively and concentrically to each other. The permanently elastic annular element is inserted into the glass body under tension and at the same time presses onto the receiving element due to the special design of the annular gap, so that a rattle-free assembly can be achieved here. Since the actual connection is made via the annular element, tolerances of both elements are essentially irrelevant.

According to a preferred embodiment, the glass body comprises a light entry surface and a light exit surface, wherein the annular gap is arranged on the side of the light entry surface. As a result, the connection between glass body and receiving element is arranged inside the luminaire so that the connection cannot be accessed from outside.

According to a further preferred embodiment, it may be provided that the receiving element is formed with a radial inner surface and the glass body with an outer lateral surface, wherein the radial inner surface and the lateral surface lie opposite each other in the installed state and wherein the support surface is arranged in the region of the radial inner surface and the receiving surface in the region of the lateral surface. Consequently, the annular gap can be provided by a simple design of the outer dimensions of both elements without the need for additional manufacturing steps. Equally, it is also possible to provide the support surface and the receiving surface without great production-related effort.

According to another preferred embodiment, the lateral surface of the glass body can extend essentially parallel to an outer lateral surface of the receiving element and the radial inner surface of the receiving element can be conically tapered in the direction of the light entry surface of the glass body. Due to the conical design of the inner surface of the receiving element, it is possible to form the annular gap initially with a wide introduction opening by which the positioning and introduction of the permanently elastic element is facilitated, and at the same time the conical design of the annular gap prevents the permanently elastic element from getting out of the annular gap during introduction, since the decreasing width of the gap already permits temporary fixing.

It has proven itself when the outer later surface of the glass body is stepped, wherein the two steps are connected to each other via a bearing surface formed perpendicular to the outer lateral surfaces. It may here be provided that the receiving element is in contact with the bearing surface of the glass body in the installed state. By forming a stepped lateral surface, a simple design measure provides a bearing surface which serves on the one hand the targeted positioning of the glass body in the receiving element and on the other hand provides an axial limitation of the receiving element on the side opposite the annular gap.

According to another preferred embodiment, the receiving surface of the glass body can be formed as an annular groove, in particular with a partially circular cross-section. An annular groove has proved particularly useful in use, as it provides a particularly good fit for the annular element.

Furthermore, it has proven itself if the support surface is arranged at an end of the annular gap facing the glass body and extends towards the glass body with a predetermined rounding. This embodiment contributes to the fixing of the receiving element by means of the annular element. In this position, the annular element in engagement with the annular groove presses on the support surface and thus ensures the fixation. The rounded surface increases the contact area with the annular element and thus increases the force exerted on the receiving elements.

Preferably, the partly circularly formed receiving surface and the rounded support surface can form partial sections of a circle and have a common circle center in the installed state. If the receiving surface and the support surface form partial sections of a common circle, a particularly secure fixing of the two elements to each other is ensured, since the annular element is held in the circular section formed by the two surfaces.

Another preferred embodiment can provide that the receiving element is formed with a transition section which in the installed state is arranged opposite an edge formed between the bearing surface and the outer lateral surface of the glass body. Since the production of the glass body in particular has considerable tolerances, the provision of the transition section facilitates the introduction of the glass body into the receiving opening and the abutment of the receiving element on the glass body, as this ensures that the receiving element actually rests on the bearing surface of the glass body.

According to another preferred embodiment, a diameter measured on the inner surface forming the annular gap and/or the support surface of the receiving element may be larger than a diameter measured in the region of the receiving surface of the glass body. This embodiment ensures a firm fixation of the permanently elastic annular element to the glass body, as the permanently elastic element can penetrate into the region with the smallest diameter and "lock in place" there.

In this case it has proven itself if the diameter of the annular, permanently elastic element is not more than, but preferably is smaller than, the diameter of the annular groove forming the receiving surface. If the diameter of the annular, permanently elastic element is slightly smaller than the diameter of the annular groove, it is kept under tension in the annular groove also in the installed state, thus improving the fixation of the two elements together.

The present invention further provides a method for connecting a receiving element of a luminaire, wherein the receiving element comprises a receiving opening for a rotationally symmetrical glass body, and a rotationally symmetrical glass body to be arranged in said receiving opening, wherein between the receiving element and the glass body an annular gap is formed which ends in the region of the receiving element in a support surface and in the region of the glass body in a receiving surface which are arranged diametrically opposite, comprising the following steps: inserting the glass body into the receiving opening of the receiving element, stretching a permanently elastic annular element to a diameter corresponding to at least the lateral surface of the glass body forming a surface of the annular gap, introducing the permanently elastic annular element into the annular gap, wherein the permanently elastic annular element is placed on the glass body, and inserting the permanently elastic annular element into the annular gap until it penetrates into the receiving surface.

It becomes clear that the method according to the invention is characterized by a few effective steps that can be taken quickly and easily. This guarantees a secure fixing of the two elements to each other and also enables a rattle-free assembly. The permanently elastic element used can compensate for the tolerances that occur during the manufacture of the glass body, so that no additional measures are necessary here.

Preferably, the glass body as well as the receiving element is designed as described above.

According to another preferred embodiment of the method, the glass body is introduced into the receiving opening until the receiving element rests on a bearing surface formed in the region of the lateral surface. The receiving element is consequently held on the glass body on the one hand in the region of the bearing surface and on the other hand by the permanently elastic element arranged opposite. This ensures that the receiving element is fixed on both sides.

BRIEF DESCRIPTION OF THE DRAWINGS

A preferred embodiment of the present invention is explained in more detail below with reference to the attached drawings, in which.

DETAILED DESCRIPTION

Figure 1:
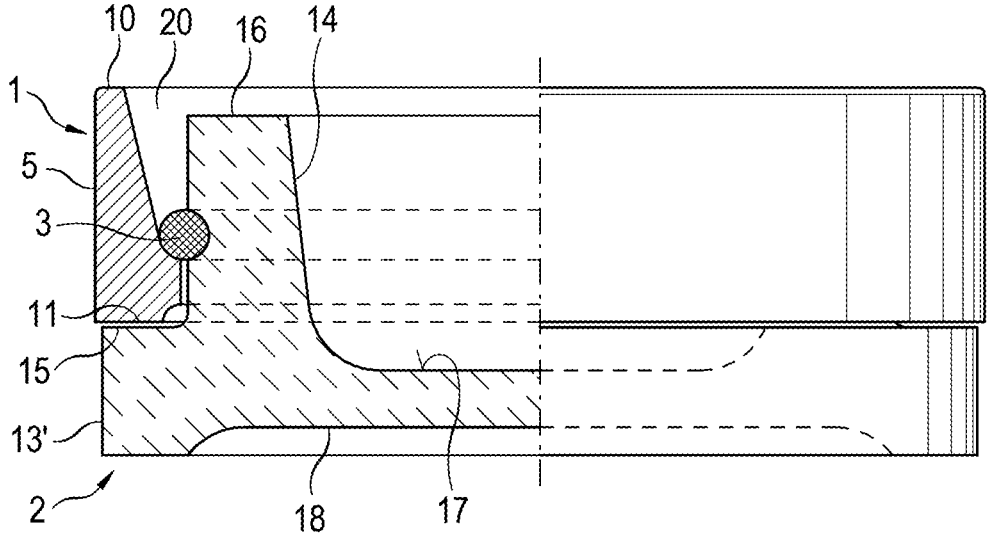
FIG. 1 shows a partial cross-section through a receiving element with the inserted glass body of a luminaire according to the invention.

FIG. 1 shows an embodiment of a luminaire according to the invention, wherein only a receiving element 1, a rotationally symmetrical glass body 2 inserted into this receiving element, and an annular, permanently elastic element 3 arranged between receiving element 1 and glass body 2 are shown of said luminaire. Light means and other elements of the luminaire are not shown.

The present invention is particularly concerned with combining these two elements in a way that provides a secure permanent connection and at the same time leads to a connection that ensures rattle-free assembly. Corresponding elements can be found in most of the known luminaires, so that a known problem is thereby addressed.

Figure 2:
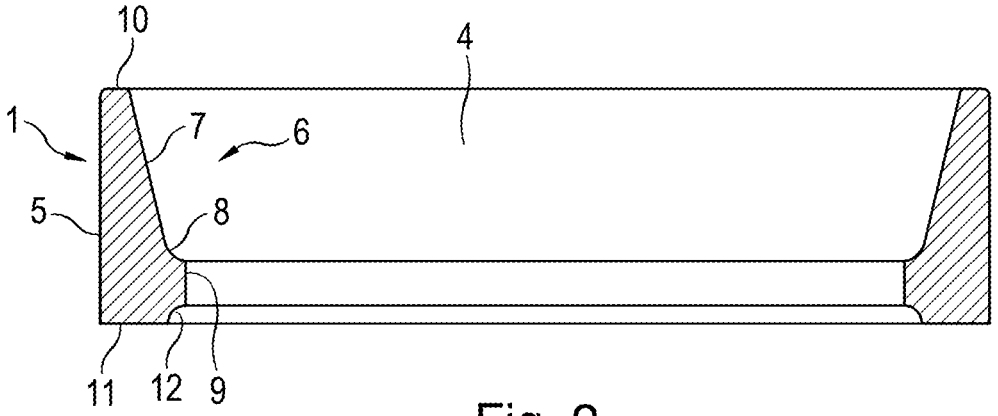
FIG. 2 shows a cross-section through the receiving element shown in FIG. 1.

As shown in FIG. 2, the receiving element 1 is a rotationally symmetrical element which is formed with a receiving opening 4. The receiving element 1 is essentially of annular shape, comprising an outer lateral surface 5 and an inner radial surface 6, which are connected to each other via two circular ring surfaces 10, 11 arranged parallel to each other. The radial inner surface 6 surrounds the receiving opening 4.

While the outer lateral surface 5 is of an essentially straight design, the radial inner surface 6 comprises three differently formed sections 7, 8 and 9. The section 7, which is the longest section relative to the height of the annular receiving element 1, is of a conical design, with the thickness of the section 7 gradually increasing in the direction of the sections 8 and 9. Consequently, the circular ring surface 10 which is adjacent to the section 7 and extends between the section 7 and the outer lateral surface 5 is smaller than the circular ring surface 11 arranged parallel thereto.

The slightly conical section 7 then merges into the section 8, which is formed with a rounding extending away from the section 7 and the outer lateral surface 5. The section 7 is followed by a straight section 9, which is arranged parallel to the outer lateral surface 5. The section 8 provides a support surface on which the annular, permanently elastic element is supported in the installed state or acts thereon.

As FIG. 2 also shows, a transition section 12 is provided between the section 9 and the circular ring surface 11, the transition section being formed as a recess and extending into the receiving element 1. This recess 12 is shown in FIG. 1 as a rounding, but may also be cornered, depending on the preferred manufacturing method.

The ratios of the individual sections to each other can be formed depending on the embodiment; in the embodiment shown, the section 7 is the longest, the section 8 is the shortest and the section 9 has an average length.

Figure 3:
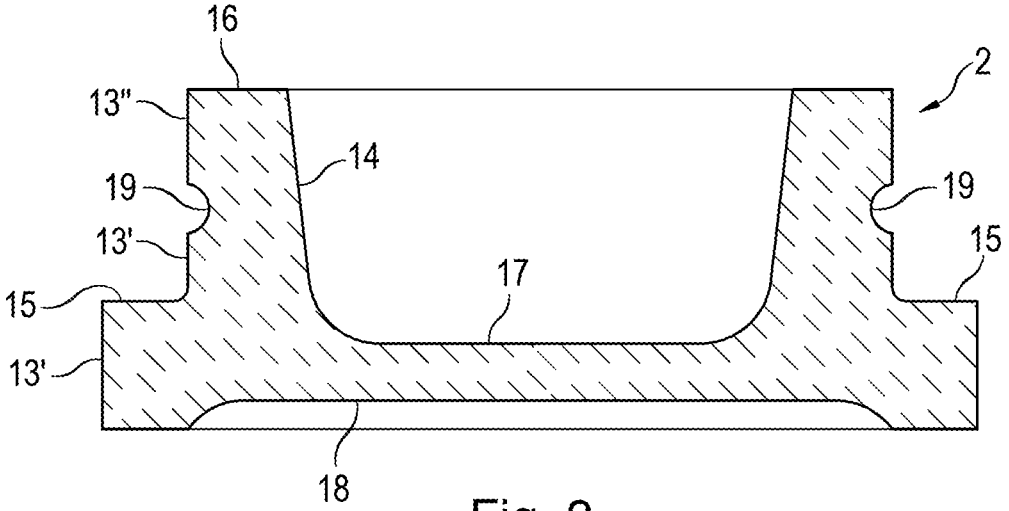
FIG. 3 shows a cross-section through the glass body of the luminaire according to the invention as shown in FIG. 1.

The glass body 2 shown in FIG. 3 is also formed as a rotationally symmetrical body with a stepped outer lateral surface 13' and 13" and an inner lateral surface 14. A bearing surface 15 is formed between the two outer lateral surfaces 13' and 13", which extends perpendicular to the two lateral surfaces 13' and 13". Furthermore, between the outer lateral surface 13" and the inner lateral surface 14 a circumferential surface 16 extending perpendicular to these is formed. Starting from the circumferential surface 16, the inner lateral surface 14 extends downwards and opens into a light entry surface 17, which can be formed parallel to the circumferential surface 16 at least in sections.

The surface of the glass body 2 opposite the light entry surface 17 is the light exit surface 18, which connects the two outer lateral surfaces 13' and can be formed at least in sections with an inwardly directed bulge. Equally, the inner light entry surface 17 can also be formed with a bulge.

Furthermore, the glass body 2 comprises a circumferential groove 19, which is at least partially formed with a circular cross-section, in the region of the outer lateral surface 13", i.e. the outer lateral surface arranged closer to the inner lateral surface 14. Said circumferential groove 19 is arranged closer to the bearing surface 15 than to the circumferential surface 16. The circumferential groove 19 is preferably formed as a circular section, wherein the center of the circle is arranged outside the glass body 2. The circumferential groove forms the receiving surface and serves to partially receive and to position the annular element 3 in the installed state.

In order to interconnect the two parts, i.e. the receiving element 1 and the glass body 2, the glass body 2 is introduced into the receiving opening 4 of the receiving element 1, the glass body with the circumferential surface 16 being inserted ahead into the receiving opening 4. Here the radial inner surface 6 of the receiving element is opposite the outer lateral surface 13" of the glass body 2. The glass body 2 is completely introduced when the circular ring surface 11 of the receiving element 1 rests on the bearing surface 15 of the glass body. At the same time, the straight inner surface section 9 of the receiving element 1 abuts on the outer lateral surface 13" of the glass body 2, or is arranged in its vicinity taking into account production-related tolerances, so that a secure positioning of the receiving element 1 in relation to the glass body 2 is ensured here.

The dimensions of the receiving element 1 and the glass body 2 are selected in such a way that the rounded section 8 in the region of the inner radial surface 6 is opposite the circumferential groove 19 of the glass body 2 in such a way that the two roundings represent partial sections of the same circle and have a common circle center or that the common axis of symmetry of their circles coincides.

In the embodiment described, these are rounded regions, but it is equally possible to form these regions essentially flat, wherein the region 8 of the receiving element 1 provides a support surface, and wherein the circumferential groove 19 of the glass body 2 provides a receiving surface. Here it is necessary that the two surfaces are diametrically opposite each other and that the surface 19 provides for a receiving and positioning of the annular element 3, which fixes the annular element 3 in the position taken.

The diameter of the glass body 2 in the circumferential groove 19, and here especially in the groove base, is smaller than the circumferential diameter of the entire radial inner surface 6 of the receiving element.

The conical shape of the section 7 of the receiving element 1 forms an annular gap 20 between the receiving element 1 and the glass body 2, which finally opens into the circle formed by the circumferential groove 19 and the region 8. This annular gap 20 is tapered due to the conical design of the section 7 and serves as an introduction region for the permanently elastic annular element 3.

In the correct end position, this permanently elastic annular element 3 is located in the circumferential groove 19 and simultaneously also in the region 8 of the receiving element 1. Thus, the circumferential groove 19 forms a receiving surface, whereas the region 19 serves as a support surface for the permanently elastic annular element 3.

For the assembly, first the glass body 2 is introduced into the receiving opening 4 of the receiving element 1, as already described, until the circumferential groove 19 and the arc-shaped section 7 are positioned such that they face each other and the common axis of symmetry of their circles coincides. In the correct installation position, the receiving element 1 with the circular ring surface 11 abuts on the bearing surface 15 of the glass body at the same time. The transition section 12 in the region of the receiving element 1 serves to compensate for any inaccuracies in the region of the glass body that may be caused by production. This ensures that the circular ring surface 11 of the receiving element 1 actually abuts on the bearing surface 15 and that the support surface 8 and the receiving surface 19 assume the correct positions relative to each other.

If the two elements are positioned axially correctly to each other in this way, the permanently elastic annular element 3 is introduced through the annular gap 20. For this purpose, the annular element is first stretched to the diameter of the lateral surface 13" of the glass body 2 and attached to this lateral surface 13". Subsequently, the annular element is axially shifted along this lateral surface until it reaches the circular circumferential groove 19. When the groove is reached, the ring retracts into the circumferential groove 19 and lies both in the circumferential groove 19 and in the arc-shaped region 9. In this state, both parts are now firmly connected to each other. The permanently elastic annular element fixes both parts positively and concentrically to each other. It is in radial contact with both the receiving element 2 and the glass body 3. In axial direction, the parts are thus fixed on the one hand by their stop into an axial direction, i.e. the circular ring surface 11 abuts on the bearing surface 15, on the other hand the annular element lying in the circumferential groove 19 and against the circular region 9 blocks a movement into the other axial direction.

The assembly is preferably carried out by a tool specially developed for introduction into the annular gap, which guarantees a fast and safe positioning of the annular element. Preferably, this tool is also of annular shape, so that for the insertion of the annular element a uniform force can be exerted thereon. According to a preferred embodiment, the tool can be formed to be conical with a shape approximately adapted to the annular gap.

The use of the permanently elastic annular element is advantageous in this context. The installation position and the ring diameter can be adjusted to each other in such a way that a slight axial tension "against" the stop of the parts remains. In this way, a preload can be generated in the system, enabling "rattle-free" assembly.

Disassembly of the system can only be achieved by destroying the permanently elastic annular element. This can be achieved by an enormous axial force, for example shearing of the permanently elastic annular element in the gap between the arc-shaped region 9 and the mounted part or by cutting and removing the annular element from above. The pull-off force required for destroying the annular element is significantly higher than the force required for holding the mounted part.

As a permanently elastic annular element, a soft elastic O-ring can here be used for example, such as a ring made of an elastomer such as silicone or EPDM.

The method according to the invention enables a very simple assembly of two components, which avoids more complex methods such as gluing. In particular, this method has proven itself for components where tolerances due to manufacture may occur.

The invention claimed is:

1. A luminaire comprising a receiving element for a glass body with a receiving opening, the glass body arranged in said receiving opening and an annular, permanently elastic element arranged between the receiving element and the glass body, wherein the receiving element is formed with a support surface which is inclined towards the glass body and the glass body is formed with a circumferential groove being provided opposed to the support surface of the receiving element, wherein the support surface and the receiving surface represent partial sections of the same circle, wherein the permanently elastic element is positioned in the installed state between the support surface and the receiving surface in order to fix the receiving element and the glass body positively and concentrically to each other, and that an annular gap is provided between the glass body and the receiving element for introducing the annular, permanently elastic element between the support surface and the receiving surface.

2. The luminaire according to claim 1, wherein the glass body comprises a light entry surface and a light exit surface, wherein the annular gap is arranged on the side of the light entry surface.

3. The luminaire according to claim 1, wherein the receiving element is formed with a radial inner surface and the glass body with an outer lateral surface, wherein the radial inner surface and the lateral surface lie opposite each other in the installed state, and wherein the support surface is arranged in the region of the radial inner surface and the receiving surface in the region of the lateral surface.

4. The luminaire according to claim 3, wherein the lateral surface of the glass body extends substantially parallel to an outer lateral surface of the receiving element and that the radial inner surface of the receiving element is conically tapered in the direction of the light entry surface of the glass body.

5. The luminaire according to claim 3, wherein the outer lateral surface of the glass body is stepped, wherein the two steps are connected via a bearing surface formed perpendicular to the outer lateral surfaces.

6. The luminaire according to claim 5, wherein the receiving element is in contact with the bearing surface of the glass body in the installed state.

7. The luminaire according to claim 3, wherein the receiving element is formed with a transition section which, in the installed state, is arranged opposite an edge formed between bearing surface and outer lateral surface of the glass body.

8. The luminaire according to claim 1, wherein the receiving surface of the glass body is formed as an annular groove, in particular with a partially circular cross-section.

9. The luminaire according to claim 8, wherein the partially circularly formed receiving surface and the rounded support surface have a common circle center in the installed state.

10. The luminaire according to claim 1, wherein the support surface is arranged at an end of the annular gap facing the glass body and extends with a predetermined rounding towards the glass body.

11. The luminaire according to claim 1, wherein a diameter measured on the inner surface forming the annular gap and/or the support surface of the receiving element is larger than a diameter measured in the region of the receiving surface of the glass body.

12. The luminaire according to claim 1, wherein the diameter of the annular, permanently elastic element is not more than, preferably smaller than, the diameter of the annular groove forming the receiving surface.

13. A method for connecting a receiving element of a luminaire, wherein the receiving element comprises a receiving opening for a glass body, and the glass body to be arranged in said receiving opening, wherein between the receiving element and the glass body an annular gap is formed which ends in the region of the receiving element in a support surface inclined towards the glass body and in the region of the glass body in a receiving surface, wherein the glass body is formed with a circumferential groove being provided opposed to the support surface of the receiving element, wherein the support surface and the receiving surface represent partial sections of the same circle, comprising the following steps:

inserting the glass body into the receiving opening of the receiving element, stretching a permanently elastic annular element to a diameter of the surface of the glass body forming a surface of the annular gap, introducing the permanently elastic annular element into the annular gap, wherein the permanently elastic annular element is placed on the glass body, inserting the permanently elastic annular element into the annular gap until it penetrates into the receiving surface.

14. The method according to claim 13, wherein the glass body is introduced into the receiving opening until the receiving element rests on a bearing surface formed in the region of the lateral surface.

* * * * *